US005201683A

United States Patent [19]

Ferri

[11] Patent Number: 5,201,683

[45] Date of Patent: Apr. 13, 1993

[54] INTERNAL STRUCTURE FOR A CRAWLING AND TALKING DOLL

[75] Inventor: Jaime Ferri, Onil, Spain

[73] Assignee: Fabricas Agrupadas de Munecas de Onil S.A., Onil, Spain

[21] Appl. No.: 741,667

[22] Filed: Aug. 7, 1991

[30] Foreign Application Priority Data

Jul. 31, 1991 [ES] Spain ..... 9101801

[51] Int. Cl.[5] ..... A63H 3/28; A63H 29/22

[52] U.S. Cl. ..... 446/299; 446/330; 446/484

[58] Field of Search ..... 446/297, 298, 299, 300, 446/302, 303, 330, 352, 353, 354, 356, 484

[56] References Cited

U.S. PATENT DOCUMENTS

| | | | |
|---|---|---|---|
| 2,277,762 | 3/1942 | Irenius | 446/298 |
| 2,804,720 | 9/1957 | Olson | 446/354 |
| 3,162,980 | 12/1964 | Hellman | 446/302 |
| 3,620,538 | 11/1971 | Mercer et al. | 446/302 X |
| 3,722,136 | 3/1973 | Thorn et al. | 446/354 |
| 4,040,206 | 8/1977 | Kimura | 446/352 |
| 4,516,951 | 5/1985 | Saigo et al. | 446/330 X |
| 4,699,603 | 10/1987 | Saigo et al. | 446/353 X |
| 4,778,432 | 10/1988 | Yeu | 446/300 |

FOREIGN PATENT DOCUMENTS

| | | | |
|---|---|---|---|
| 2023015 | 12/1979 | United Kingdom | 446/484 |
| 2063691 | 6/1981 | United Kingdom | 446/300 |
| 2119264 | 11/1983 | United Kingdom | 446/353 |
| 2215227 | 9/1989 | United Kingdom | 446/353 |

*Primary Examiner*—D. Neal Muir
*Attorney, Agent, or Firm*—Steven J. Henry

[57] ABSTRACT

The doll of the invention incorporates a mechanism and electric circuit that, originating from a general activation motor which moves a series of engagements, brings about a correlative series of movements which cause the doll to crawl and give out a message and, subsequently, to stop crawling and raise the trunk of its body and head, to turn its head and give out a new message. These movements are based on the eccentric operating several elements related to the arms, legs and head. Likewise, the emission of the messages is based on parts which are independent but combined electrically and mechanically with the general mechanism in order that, altogether, they achieve a succession of movements which are repeated constantly until a general switch is activated by means of, for example, a dummy, or by means of a ball switch activated automatically when the doll is picked up and put upright.

8 Claims, 6 Drawing Sheets

INTERNAL STRUCTURE FOR A CRAWLING AND TALKING DOLL

The invention refers to a crawling and talking doll, which has the special feature of incorporating a series of elements functionally combined one with another in order to establish an electromechanical mechanism which, once it is activated, makes the doll, when lying face downwards (on her hands and knees), carry out successively a series of movements at the same time as it gives out two kinds of messages, depending on the position at that moment. The movements which are carried out result in the doll crawling along and simultaneously giving out one type of message; after a period of time, the doll stops crawling and begins to raise the trunk of her body and her head, turning the latter to one side to look upwards, giving out a different message with this second type of movement. Following this, once the highest position has been reached, the doll stops and begins to lower itself to return to its original position, repeating the cycle indefinitely, unless a general switch is activated, triggered either when a dummy is put in the doll's mouth or the doll is picked up and put in the upright position, by means of a ball switch which will operate independently of the general switch triggered by the dummy.

In the field of doll manufacturing, although there are innumerable types of mechanisms which bring about the activation and respective movements of specific parts and/or limbs of a doll, such as walking, talking, jumping and even crawling, no electromechanical system is known which as a whole causes the series of movements and talking actions referred to beforehand. Therefore, the system included in the doll of this invention may be considered completely innovative.

SUMMARY OF THE INVENTION

More specifically, the whole mechanism or system includes a general activation motor and a motor for the activation of the sound disc or message emitter, both operating independently, although they are connected with each other so that, as a result of the functioning of the elements corresponding to the sound device, the motor of the general mechanism starts to work. This motor had previously interrupted its functioning because at a given moment it is disconnected, stopping the general mechanism, although the sound disc motor continues operating in order to give out the message, and also to start up the motor of the general mechanism again, as will be explained in detail below.

Specifically, the general mechanism includes a pair of cog wheels which are set in motion simultaneously, since they are assembled on the same axle that operates the arms and legs, by means of a long cogged pinion or cylinder, which in turn is set in motion by a transmission coming from the activation motor itself.

On the sides that face each other, these two cog wheels have ramp like protrusions which, in a specific position, are so placed that the inclined rims of these ramps come into contact with each other, making the two wheels reach the closest position possible in respect to each other.

One of these wheels has one more cog, so that the rotation speed of both is different. This causes one ramp to push the other, and, eventually, one of the wheels to move away from the other. This movable wheel is, of course, assembled freely, so that it can move axially on its assemblage axle. This separation, which is brought about against the action of a spring, makes a joint pinion in the opposite side of that wheel engage another wheel which transmits the movement to the arms, as well as to the head, and, at a given moment, to the sound device. A fundamental part, assembled at the end of the axle of the latter cog wheel, intervenes in that transmission of movements. That fundamental part is a cam whose rotation axle is eccentric and includes a peripheral sector whose radius of curvature has its center in the rotation axle itself. One of the ends of a swinging, elbowed arm rests permanently on the said cam. The other end constitutes the means for the transmission of the different movements. During the rotation of the cam, the resting end of the above mentioned lever causes the pressure to rest on one or another of the sectors included in the periphery, so that when it rests on a particular point, the doll, as it were, crawls and gives out a message. When, in its rotation, it rests on the sector whose radius of curvature corresponds with the rotation axle of the cam, then the doll reaches its highest position, having previously rested on the sector in which the beginning of the elevation towards that highest position takes place, and finally it rests on the last sector of the cam, during which a lowering of the doll towards the low position is carried out.

The doll remains in the highest position for a period of time as a result of the disconnection of the motor of the general mechanism. This disconnection is brought about by a small protrusion joined to the inner side of the said cam which activates a switch that opens the supply circuit of the motor. Therefore the mechanism stops, and the doll remains in the raised position, although during this period the doll moves due to impulses produced by the working of the sound device.

During the rotation of the assemblage axle of the said cam the rotation of another cam situated on the opposite side starts at the same time as the movements described above. Likewise, there is an elbowed lever resting on the cam which operates an arm joined to the sound device, more specifically to the arm with the needle which comes into contact with the recording of the sound message. Thus, since the sound disc is constantly working, because it is activated by an independent motor, the movement taking place in the lever with the needle which belongs to the sound device, as a result of the previously described activation, causes this lever to come into contact with one or the other of the two tracks of the sound disc, giving out one or the other of the messages, according to the position of the doll. This lever also closes the circuit of the general activation motor, so that the mechanism starts working again and causes the raising of the doll and subsequent lowering to its original position. Therefore, we could say that the movement, from the beginning of the raising of the doll to the beginning of its lowering, is caused by the actual impulses of its voice, since it is the sound device which starts up the general mechanism, having previously been disconnected and stopped at the moment when the raising of the doll begins, it is necessary to clarify that the lowest position of the doll, that is, when it is crawling, corresponds to that position in which the ramp like protrusions of the two basic wheels of the gear are disengaged, that is to say, not coming into contact with each other; whereas the highest position of the doll corresponds to that in which these ramp like protrusions face each other, so that the course during which one of the ramps slides over the other corresponds to the raising phase of the doll, from the low crawling position to the high position.

It is also necessary to point out that the legs of the doll move by means of several elements, each made up of a sort of long, thin metal plate or rod with an intermediate stretch in the form of a spring or elastic part, that not only allows the doll to crawl, but also, because of the particular positioning of the above elements, allows the doll to adopt a sitting position without any difficulty.

BRIEF DESCRIPTION OF THE DRAWINGS

To provide a better understanding of the features of this invention, a detailed description is given below, based on a set of diagrams included in this descriptive report and forming part of it, in which the following has been presented merely to serve as a guidance without intending to be limiting.

Finally.

DETAILED DESCRIPTION OF THE INVENTION

Figure 1:
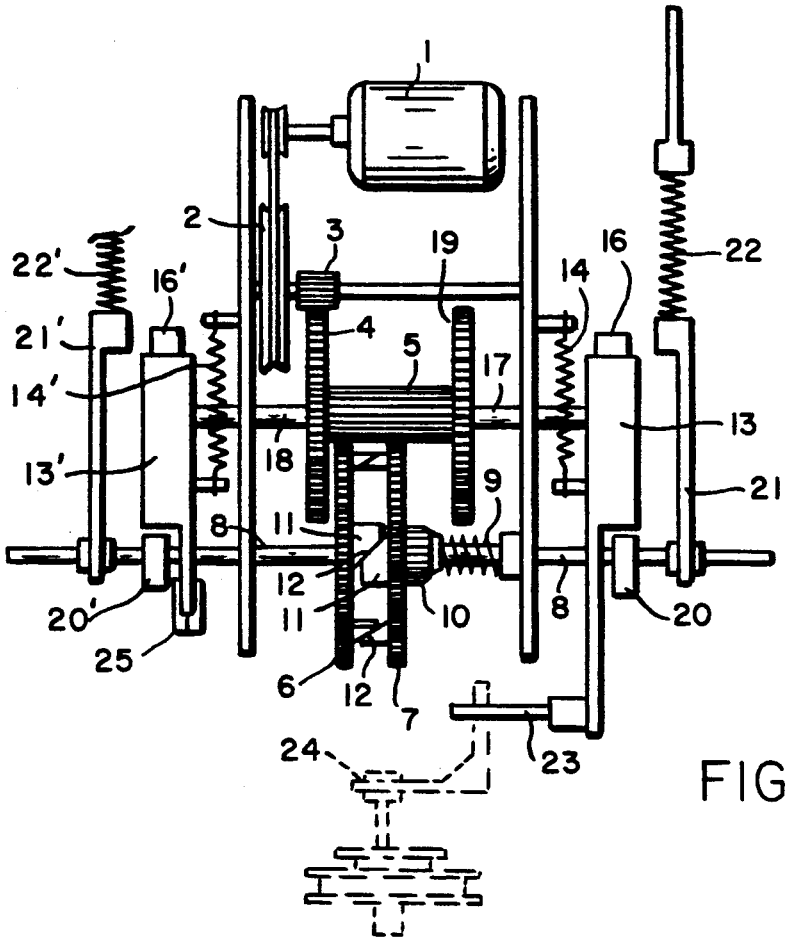
FIG. 1 shows a diagram of the general mechanism in the position which corresponds to the doll crawling, but beginning to raise.

As can be seen in the above figures, the general, mechanism moves when the motor is activated (1), and this, by means of a transmission system consisting of pulleys and a belt (2), makes the pinion turn (3), which, as it rotates, engages the cog wheel (4), joined axially to a cogged cylinder (5), in which two cog wheels (6 and 7) are permanently engaged. One of these has one cog less so that their speed of rotation is different. These cog wheels (6 and 7) are assembled on the same axle (8), but with the special feature that the wheel (7) is able to move axially on this axle (8), against the action of a spring (9), when the movement is in the opposite direction with respect to the other wheel (6), since in the movement which brings them closer together, the spring itself (9) pushes that cog wheel (7) which has on its outer side a pinion (10) which rotates together with it.

Figure 2:
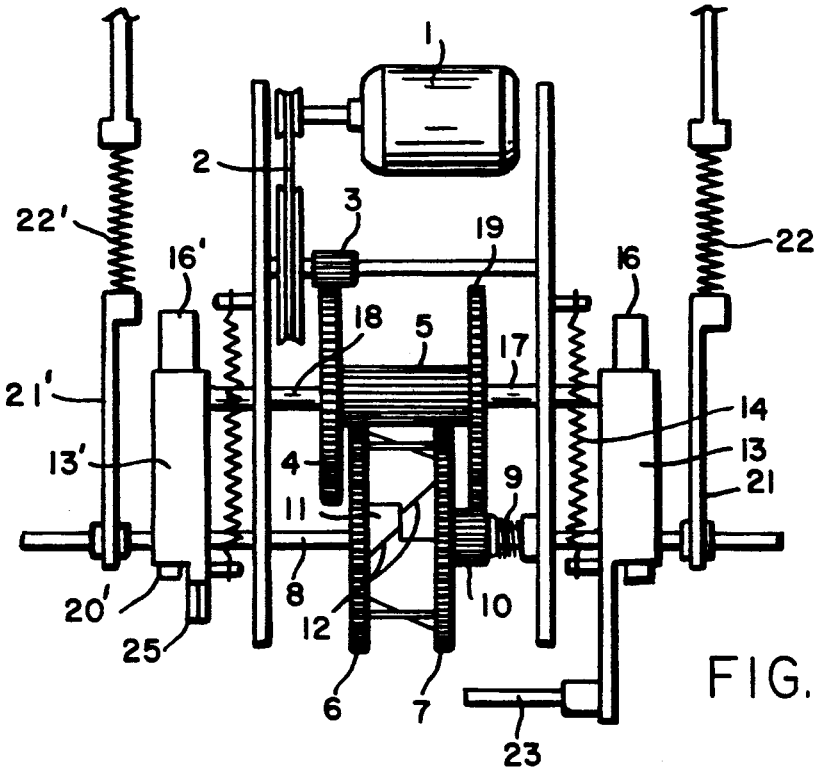
FIG. 2 shows the same diagram of the general mechanism in the highest position of the doll.
Figure 3:
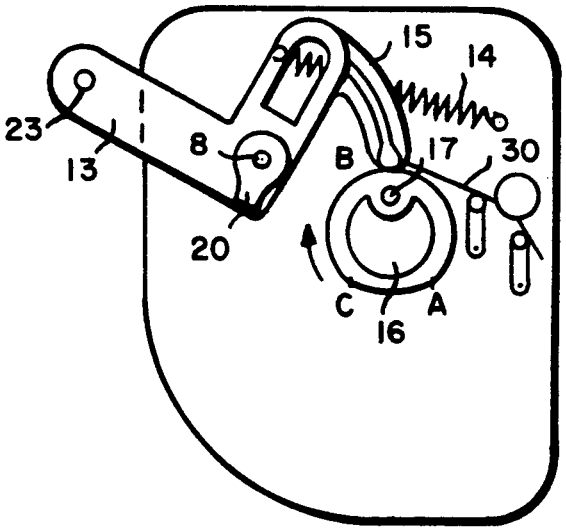
FIG. 3 shows the position of the main cam when the general mechanism corresponds to the mechanism shown in FIG. 1, likewise showing the resting of the respective elbowed lever by which the movements are transmitted.
Figure 4:
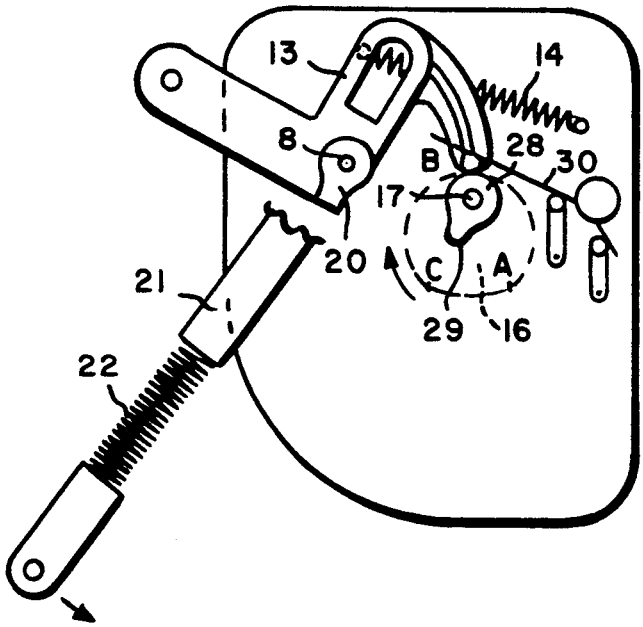
FIG. 4 shows the same part shown in the former figure, but seen from the inside in order to appreciate the protrusion of the cam, responsible for the opening and closing of the circuit at a given moment.
Figure 5:
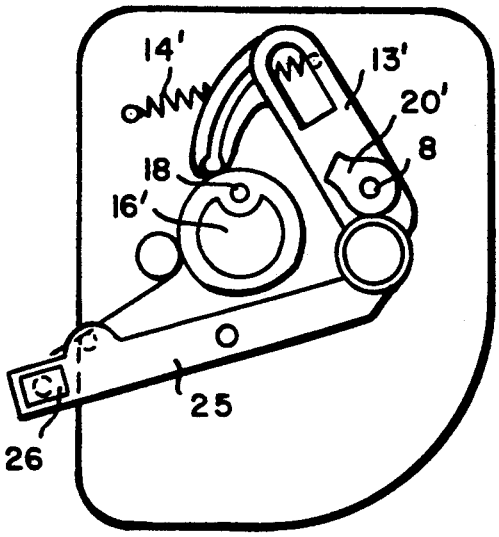
FIG. 5 shows the side opposite to the one shown in FIGS. 3 and 4, with the mechanism in the same position.
Figure 6:
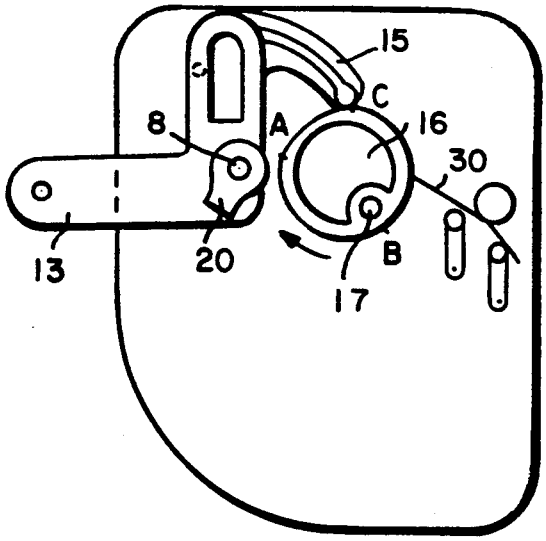
FIG. 6 shows another position of the main cam, corresponding to the highest position of the doll.
Figure 7:
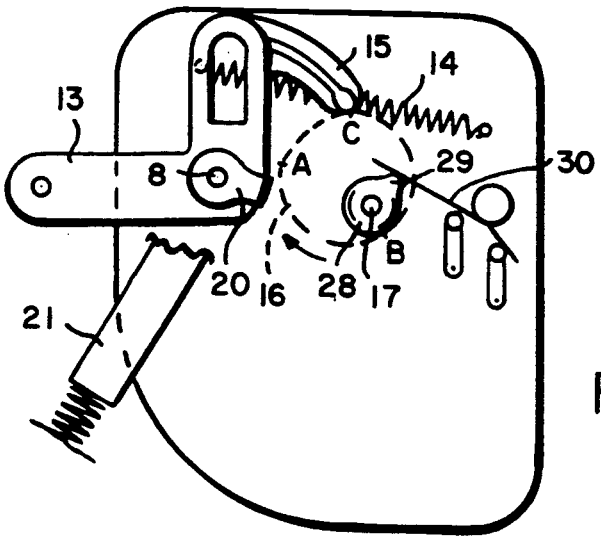
FIG. 7 shows the same part shown in the former figure, but seen from the inside in order to appreciate how the protrusion of the cam disconnects the supply circuit of the general motor, the whole general mechanism stopping at the moment in which that position is reached.
Figure 8:
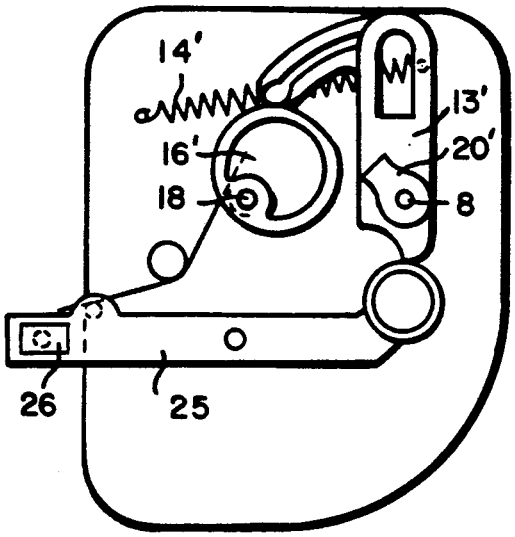
FIG. 8 shows the side opposite to the one shown in FIGS. 6 and 7, with the mechanism in the same position.

These wheels (6 and 7) have, on their facing sides, a number of complementary protrusions (11) with oblique edges (12), which establish in each case what could be considered as ramps. These come into contact by means of the oblique edges (12) at a particular moment or position, such as the stage illustrated in FIG. 1, to later move apart without contact of any type, such as it is illustrated in FIG. 2, although in this case they are facing each other and this figure corresponds to the position that immediately follows that when the above-mentioned edges, which determine the ramps, have stopped being in contact.

A swinging lever (13), which is assembled freely at one end of the axle (8), is permanently directed by means of a spring (14) towards a position of constant resting of its end (15) on the periphery of a main cam (16) assembled eccentrically on the axle (17) which forms the axle (18) of the pinion (5). On the former axle (17) a cog wheel (19) is assembled, on which the pinion (10) can engage when the wheel (7) moves away from the other wheel (6), so that the rotation of the pinion (5) and of the wheel (4) assembled on the axle (18) are independent of the rotation of the wheel (19) and cam (13) assembled on the axle (17).

The axle itself (8), next to the swinging lever (13), has a small cam (20) joined to it, after which the above-mentioned axle extends through a section on which the articulation element (21) and the legs and arms of the doll are articulated. This element, which is straight, has an intermediate elastic stretch (22), in the form of a spring, which allows it to transmit adequately the movements to the legs so that the doll crawls and can also adopt the sitting .-position.

At the other end, that is, on the other side of the axle (8), another lever (13') is assembled, with one end permanently resting, directed by the spring (14') onto the cam (16') assembled eccentrically on the axle (18). Also, at the end of this side, there is a small cam (20') on the axle (8).

The swinging levers (13 and 13') are elbowed, and whereas the free end of the first has an adjunct (23) which joins with some known parts (24) in order to bring about the movements of the head, the free end of the second lever (13') operates an arm (25), also swinging, with a small hole (26) at its end by which it is joined to the arm with the needle (27) belonging to the sound device, which is described below. At this end of the axle (8), the respective element (21') with its intermediate elastic stretch (22') is assembled so that it transmits the movement of the leg of that side, and the respective arm of the doll is assembled at the end of that side of the axle (8). The main cam (16), like the other (16'), has its periphery in such a way that can be considered as made up of three successive sectors confined to the letters A, B and C, in which the radius of curvature of sector AC has its center precisely on the axle (17). This main cam (16) has, joined to it on its inner side, a sort of secondary cam (28) with a protrusion (29). The latter, as it rotates, is able to push a conductor (30) which opens and closes the respective supply circuit of the motor (1).

Figure 9:
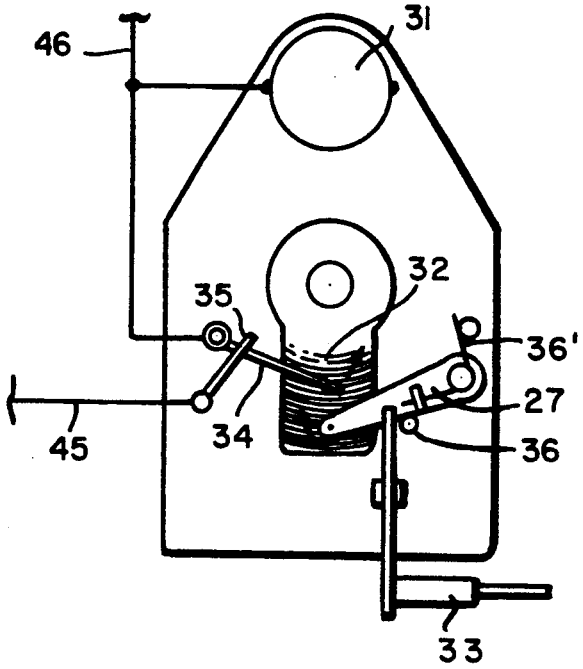
FIG. 9 shows the ground plan of the inside of the box containing the sound device, also illustrating the arm with the needle, the track of the sound disc and the parts responsible for closing the circuit which sets the general mechanism in motion.

Going back to the sound device, it should be said that it includes an independent mot (31) which activates the respective disc (32), having only a small portion exposed as seen in FIG. 9, where there are two different tracks, each giving out its own message, according to whether the corresponding needle, assembled on the arm (27) joined to the arm (25) that belongs to the general mechanism, comes into contact with one or the other track.

A moving part (33), passed through the small hole (26) and positioned between the arm (25) and the arm with the needle (27), constitutes a join. The end of this moving part is able to contact the arm (27), according to its position. In one case the end of this moving part intercepts and pushes the arm (27) which in turn pushes a hoop (34) which comes into contact with the terminal (35), closing a secondary supply circuit of the general motor (1); whereas when this handle is outside the sphere of the arm (27), the latter hits against the pivot (36), causing the disconnection of the corresponding above mentioned circuit. The arm (27) is connected to a spring with a pushing action (36').

Figure 10:
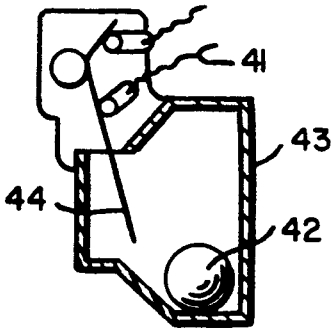
FIG. 10 shows a ball-type switch completing the circuit, which corresponds to the operating position of the doll.
Figure 11:
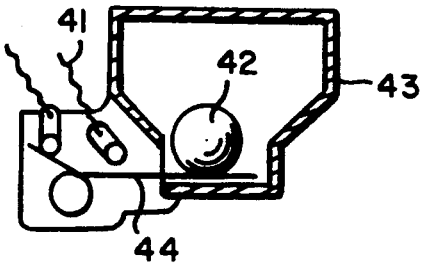
FIG. 11 shows a detail in section of the same switch as in the former figure, in the position of the disconnection of the circuit, which corresponds to the raising and sitting positions of the doll.
Figure 12:
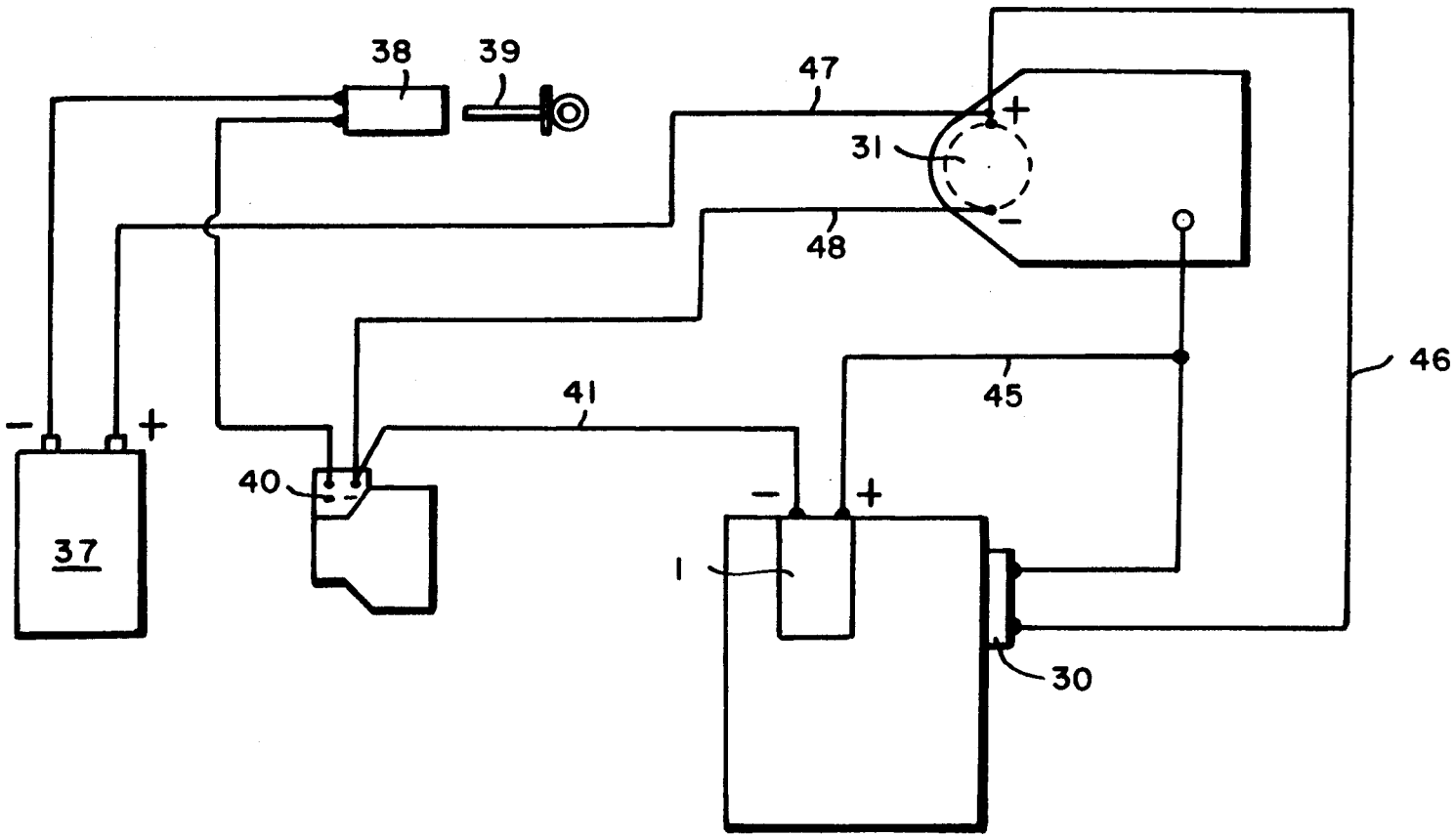
FIG. 12 shows the plan corresponding to the general electric circuit included in the doll, illustrating the association or connection between the parts of the activation circuit of the general mechanism and the sound device.
Figure 13:
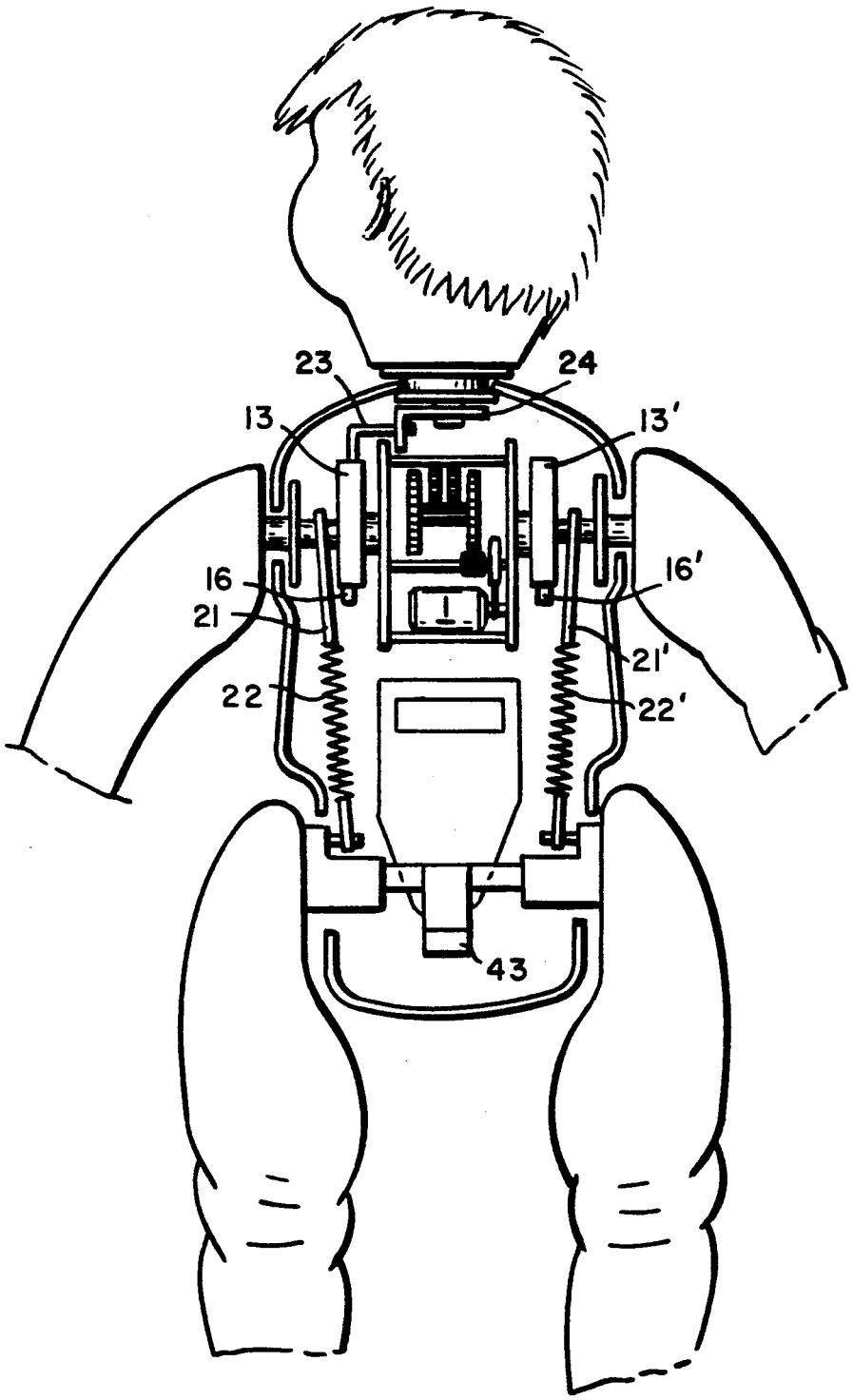
FIG. 13 shows a general diagram of the doll mechanism within a doll body.

FIG. 12 shows the general supply circuit of the motor (1), powered by batteries (37), and has on one side a general switch (38) which can be activated, for example, by a dummy (39) when it is taken out of the doll's mouth. This switch (38) disconnects the whole system when the dummy (39) is inserted. The circuit is joined to a secondary switch (40), for example the classic "ball type", shown in FIGS. 10 and 11 which illustrate that in the functioning position of the doll, the ball (42) keeps the motor (1) supplied by means of the conductor (41), whereas in any other position of the doll, the ball (42) moves and opens the circuit by disconnecting that conductor. The said ball (42) is inside a box (43) and activates a connector (44), opening and closing the circuit, as has just been explained.

The conductors (45 and 46) coming out of the sound device can supply the motor (1) when contact is made between the hoop (34) and the connector (35). This takes place because the motor of the sound device (31) is supplied independently through the conductors (47 and 48) by means of the secondary switch (40).

According to the arrangement described, the functioning is as follows:

Starting from a particular point or position, for example that corresponding to those shown in FIGS. 1, 3, 4 and 5, the levers (13 and 13') rest on point B of the cams (16 and 16'). As the direction of the rotation is shown by the arrow featured in those fiqures, the transmission of the movement takes place through the two cog wheels (6 and 7), leaving the pinion (10) disengaged from the wheel (19), as a result of which the cams (16 and 16') remain at rest. The rotation of the wheels (6 and 7) brings about, on one hand, the transmission of the movement to the legs and arms of the doll, which is logically carried out by means of the axle (8), elements (21 and 21') and small cams (20 and 20'). These movements make the doll perform the function or action of crawling. At the same time, since the sound device is constantly connected, the emission of the voice takes place, giving out a message, the needle of the arm (27) having come into contact with a particular area or track of the recorded disc (32).

During this crawling movement and the emission of the doll's voice, because the wheels (6 and 7) have a different number of cogs, one of them rotates at a higher speed, causing the inclined edges (12) corresponding to the protrusions (11) to face each other and slide, bringing about the displacement of the wheel (7), one moving away from the other wheel (6). At a given moment the protrusions (11) reach a position where they are facing each other, as a result of the ramps (12) having ceased to be in contact with each other. Due to the displacement of the wheel (7), the pinion (10) having previously engaged the cog wheel (19) on whose axle the cams (16 and 16') are assembled, causes them to rotate correspondingly. That is to say, when the protrusions reach the position corresponding to the FIGS. 2, 6, 7 and 8, the cams (16 and 16') have already made a partial rotation, moving from the point of contact B of the levers (13 and 13') to the point of contact C. During this movement the crawling of the doll takes place up to the beginning of the raising and the turning of the head, as well as the stopping of the general mechanism because the protrusion (29) of the part (28) joined to the cam (16) has pushed the terminal (30), leaving the motor (1), and therefore the mechanism, disactivated. When this happens, the doll remains in that position while the cam (16) passes from position C to position A, that is, while it goes through the stretch CA, whose radius of curvature has the same center as the axle (17) of the eccentric (16). During that period of time the doll moves by impulses due to the functioning of the sound device which connects and disconnects the secondary supply circuit of the motor (1). Besides these movements by impulses, a movement of the head occurs.

As has already been said, the sound device has a permanent supply, and in these above-mentioned movements the lever (13') will have come into contact with the lever or arm (25), which by means of its connection with the handle (33) pushes in some cases the arm with the needle (27), changes the track and gives out other voices. This pushing brings about precisely the closing of the secondary supply circuit of the motor (1) that takes place when the hoop (34), pushed by the arm, contacts the terminal (35), so that, through these conductors (45 and 46), the secondary circuit is closed and the activation of the general mechanism takes place, as had been said previously. When the arm (27) is no longer being pushed, then the secondary circuit is disconnected again and the cycle is repeated in this way during a period of time. Thus, it can be said that the mechanism, when the doll is in its highest position, operates by impulses given out by the sound device.

Once the cam (16) reaches the point of rest A, the protrusion (29) ceases to activate the terminal (30) and allows the general circuit to close again, whereby the movement of the mechanism starts bringing about the lowering of the doll's body until it reaches the normal position of crawling. This movement takes place during the time elapsed between point B and A of the eccentric (16). From that moment on, the original position is reached and the cycle will be repeated constantly unless the general switch (38) is turned off either by introducing the dummy (39) or by picking up the doll and placing it in a more or less upright position, activating the ball switch (40) which also closes and disconnects the whole circuit, including the sound device.

I claim:

1. A crawling and talking doll having movable arms, legs, trunk and head, comprising:

an activation motor for powering a general mechanism for moving said arms, legs and head through a series of movements, said series of movements comprising crawling, stopping, simultaneously raising said trunk and moving said head, and stopping;

a synchronized sound device which emits one of two messages, said sound device being activated by an independent motor;

said general mechanism comprising:

first and second cog wheels, one of said cog wheels having one more cog than the other of said cog wheels, a cog cylinder for engaging said first and second cog wheels;

a transmission means for providing rotational movement to said cog cylinder;

wherein said first cog wheel is fixed to an axle assemblage, said second cog wheel being capable of axial displacement relative to said axle assemblage;

said second cog wheel having a pinion disposed on an opposite side of said second cog wheel than said first cog wheel, said pinion being capable of engaging a third cog wheel on a second axle;

a pairs of cams disposed on the ends of said second axle;

a pair of swinging levers disposed so that ends of said levers rest on said pair of cams;

one of said pair of levers being connected to means for moving said head, a second of said pair of levers being connected to a first arm joined to a second arm carrying a needle of said sound device;

said first and second cog wheels have protrusions with oblique edges forming ramps, on sides facing each other, so that the second cog wheel moves axially toward and away from said first cog wheel;

wherein when said first and second wheels are rotated, said second cog wheel moves away from said first cog wheel, said pinion engages said third cog wheel to rotate said pair of cams, thus raising said trunk and turning said head while said sound device emits a first message, wherein one of said pair of cams has a secondary cam joined thereto, to disconnect said first motor and stop movement of said trunk and head and emission of said first message; and wherein when said pinion is out of engagement with said third cog wheel, said axle assemblage is rotated so that said arms and legs move, creating a crawling motion of said doll while said sound device emits a second message.

2. A crawling and talking doll as recited in claim 1, wherein said pair of cams each further comprises a periphery having three separate radiuses of curvature, a first radius of curvature has its center corresponding to the second axle.

3. A crawling and talking doll as recited in claim 2, further comprising a second pair of cams disposed on the axle assemblage for transmitting movements from the axle assemblage to said arms, head and legs of said doll.

4. A crawling and talking doll as recited in claim 3, further comprising a pair of springs for biasing said swing lever to permanently rest on the periphery of respective ones of said first pair of cams.

5. A crawling and talking doll as recited in claim 4, further comprising elements for transmitting movement to said legs, including an elastic means for allowing the doll to adopt a sitting position.

6. A crawling and talking doll as recited in claim 5, wherein said secondary cam further comprises a small protrusion extending laterally from one of said pair of cams for opening the supply circuit of the activation motor when one of said pair of swinging levers passes over the first radius of curvature of said pair of cams so that said sound device emits one of said two messages.

7. A crawling and talking doll as recited in claim 6, wherein said sound device further comprises a recorded disk having an arm with a needle, a hoop contact and a terminal, said hoop contacting push by said arm having said needle to close the supply circuit of the activation motor, when said trunk of said doll is raised, and wherein when said doll is in a crawling position, said arm with said needle is disposed against a pivot.

8. A crawling and talking doll as recited in claim 7, further comprising a general supply circuit as said activation motor, supplied by one of said sound device or a secondary switch, said general circuit having a second switch operated by a dummy for disconnecting the generally supply circuit, and wherein said secondary switch is activated by the position of said doll, so that the activation motor is deactivated while the independent motor of the sound device receives a constant supply providing the switch for the general circuit is deactivated, and wherein the secondary switch disconnects the activation motor and independent motor when placed in a second position.

* * * * *